US011470982B2

(12) United States Patent
Johannessen

(10) Patent No.: US 11,470,982 B2
(45) Date of Patent: Oct. 18, 2022

(54) AIR MATTRESS WITH TENSIONED COVER

(71) Applicant: Mark Johannessen, Lansdale, PA (US)

(72) Inventor: Mark Johannessen, Lansdale, PA (US)

( * ) Notice: Subject to any disclaimer, the term of this patent is extended or adjusted under 35 U.S.C. 154(b) by 519 days.

(21) Appl. No.: 15/975,884

(22) Filed: May 10, 2018

(65) Prior Publication Data

US 2018/0360228 A1 Dec. 20, 2018

Related U.S. Application Data

(60) Provisional application No. 62/521,735, filed on Jun. 19, 2017.

(51) Int. Cl.

| | |
|---|---|
| ***A47C 31/10*** | (2006.01) |
| ***A47C 27/08*** | (2006.01) |
| ***A47G 9/02*** | (2006.01) |

(52) U.S. Cl.

CPC ..... *A47C 31/105* (2013.01); *A47C 27/081* (2013.01); *A47G 9/0261* (2013.01)

(58) Field of Classification Search

CPC .... A47C 31/105; A47C 27/081; A47G 9/0261

See application file for complete search history.

(56) References Cited

U.S. PATENT DOCUMENTS

| | | | | |
|---|---|---|---|---|
| 2,537,652 | A * | 1/1951 | Churchill | A47C 31/105 5/499 |
| 5,491,854 | A | 2/1996 | Music | |
| 5,666,680 | A * | 9/1997 | Hackett, Jr. | A47G 9/0246 5/496 |
| 9,737,153 | B2 * | 8/2017 | Chaffee | A47C 7/021 |
| 2004/0003471 | A1 * | 1/2004 | VanSteenburg | A47C 27/081 5/709 |
| 2005/0005363 | A1 * | 1/2005 | Giori | A47C 27/081 5/709 |
| 2012/0233776 | A1 * | 9/2012 | Agarwall | A47C 21/022 5/496 |
| 2012/0233832 | A1 * | 9/2012 | Hooley | A47C 17/20 29/401.1 |
| 2012/0272456 | A1 * | 11/2012 | Lemmer | A47C 27/081 5/710 |

* cited by examiner

*Primary Examiner* — Eric J Kurilla

(74) *Attorney, Agent, or Firm* — Lamon Patent Services; Cynthia S. Lamon

(57) ABSTRACT

An air mattress assembly includes an air mattress and a cover system. The cover system is made of a fabric material. The air mattress, if fully inflated without the cover system in place, would be too large for the cover to fit over the fully inflated air mattress. With the cover system in place around the air mattress, the cover system will be under tension when the air mattress is inflated to operational pressures. In some embodiments the cover is bonded to the air mattress.

8 Claims, 15 Drawing Sheets

AIR MATTRESS WITH TENSIONED COVER

CROSS-REFERENCE TO RELATED APPLICATIONS

This application claims the benefit of U.S. Provisional Application No. 62/521,735, filed on Jun. 19, 2017, which is incorporated herein by reference in its entirety.

BACKGROUND OF THE INVENTION

Air mattresses are used to provide a comfortable support on which a person or persons can sleep. The pressure of the air within the mattress is intended to support the weight of the person and allow the surface of the mattress to conform to the person's body. The pressure of the air within the mattress is also intended to provide cushioning of the person's body from contact with any hard surfaces underlying the mattress. Currently available air mattresses have not been completely successful in meeting these goals. Currently available air mattresses have a tendency to sink in the middle and subject the person lying on them to the discomfort of contact with the hard surfaces underlying the mattress. Currently available air mattresses lack sufficient rigidity and would push through a bed frame unless provided with closely spaced supports or with a continuous supporting surface such as provided by a box spring. As a result, bed framing associated with current air mattresses is heavier and less portable than desired. The need persists in the art for an air mattress that would obviate the problems associated with currently available air mattresses.

SUMMARY OF THE INVENTION

The present invention is directed to an air mattress assembly including an air mattress and a cover system including a top cover for the top of the mattress and a bottom cover for the bottom of the mattress. The air mattress and at least the top and bottom covers are adapted and configured such that, when the air mattress assembly is inflated to a pressure with the pressure range suitable for use of the air mattress assembly, at least the top and bottom covers are in tension. The tension in the top and bottom covers provides enhanced comfort and structural integrity to the mattress.

Accordingly, it is an aspect of the present invention to provide an air mattress assembly comprising:

an air mattress, wherein the air mattress is flexible and inflatable and is capable of containing a volume of air under pressure, wherein the air mattress has a closable inlet for filing the air mattress with air, the air mattress having a top, a bottom and sides extending between the top of the air mattress and the bottom of the air mattress; and a cover system including a top cover and a bottom cover, the top cover covering the top of the air mattress, the bottom cover covering the bottom of the air mattress, the air mattress assembly being inflated to a pressure within a correct operating pressure range for use, the air mattress assembly having a length and a width when the air mattress assembly is inflated to the pressure within the correct operating pressure range, wherein the air mattress has a length and a width prior to assembly with the cover system and when inflated to the pressure within the correct operating pressure range, wherein at least the width of the air mattress prior to assembly with the cover system, when inflated to the pressure within the correct operating pressure range, is greater than the width of the air mattress assembly when the air mattress assembly is inflated to the pressure within the correct operating pressure range, such that both the top cover and the bottom cover are in tension when the cover system is assembled with the air mattress and the air mattress assembly is inflated to the pressure within the correct operating pressure range.

It is another aspect of the present invention to provide an air mattress assembly according to any of the other aspects of the present invention disclosed herein, wherein the length of the air mattress prior to assembly with the cover system, when inflated to the pressure within the correct operating pressure range, are greater than the length of the air mattress assembly when the air mattress assembly is inflated to the pressure within the correct operating pressure range, such that both the top cover and the bottom cover are in tension when the cover system is assembled with the air mattress and the air mattress assembly is inflated to the pressure within the correct operating pressure range.

It is still another aspect of the present invention to provide an air mattress assembly according to any of the other aspects of the present invention disclosed herein, wherein the air mattress is made of a first material, and wherein the top cover and the bottom cover are made of a second material that is different from the first material.

It is yet another aspect of the present invention to provide an air mattress assembly according to any of the other aspects of the present invention disclosed herein, wherein the top cover and the bottom cover form parts of a sleeve having an opening that allows the air mattress to be received within the sleeve when the air mattress is deflated, the sleeve being too small to receive the air mattress within the sleeve when the air mattress is inflated to the pressure within the correct operating pressure range.

It is yet another aspect of the present invention to provide an air mattress assembly according to any of the other aspects of the present invention disclosed herein, wherein the opening of the sleeve is provided with closure means to selectively close the opening even after the air mattress assembly is inflated to the pressure within the correct operating pressure range and to selectively allow the opening to be opened for insertion or removal of the air mattress at least when the air mattress is deflated.

It is yet another aspect of the present invention to provide an air mattress assembly according to any of the other aspects of the present invention disclosed herein, wherein the top cover and the bottom cover each have a length and a width before they are tensioned by inflation of the air mattress assembly to a pressure within the correct operating pressure range, wherein at least the width of the top cover before tensioning is less than the width of the air mattress when the air mattress is inflated to the pressure within the correct operating pressure range prior to assembly with the cover system.

It is yet another aspect of the present invention to provide an air mattress assembly according to any of the other aspects of the present invention disclosed herein, wherein the length of the top cover before tensioning is less than the length of the air mattress when inflated to the pressure within the correct operating pressure range prior to assembly with the cover system.

It is yet another aspect of the present invention to provide an air mattress assembly according to any of the other aspects of the present invention disclosed herein, wherein the width of the bottom cover before tensioning is less than the width of the air mattress when inflated to the pressure within the correct operating pressure range prior to assembly with the cover system.

It is yet another aspect of the present invention to provide an air mattress assembly according to any of the other aspects of the present invention disclosed herein, wherein the length of the bottom cover before tensioning is less than the length of the air mattress when inflated to the pressure within the correct operating pressure range prior to assembly with the cover system.

It is yet another aspect of the present invention to provide an air mattress assembly according to any of the other aspects of the present invention disclosed herein, wherein the sides of the air mattress have a height prior to assembly with the cover system and after inflation to the pressure within the correct operating pressure range, wherein the sleeve further comprises sidewalls extending between the top cover and the bottom cover, the sidewalls having a height, the height of the sidewalls of the sleeve being less than the height of the sides of the air mattress.

It is yet another aspect of the present invention to provide an air mattress assembly according to any of the other aspects of the present invention disclosed herein, wherein the top and bottom covers are made of a woven fabric.

It is yet another aspect of the present invention to provide an air mattress assembly according to any of the other aspects of the present invention disclosed herein, wherein the cover system has a length and a width in the absence of tension in the top and bottom covers, wherein the length of the air mattress prior to assembly with the cover system, when inflated to the pressure within the correct operating pressure range, is in the range of from about one to about twenty inches greater than the length of the cover system in the absence of tension in the top and bottom covers, and wherein the width of the air mattress prior to assembly with the cover system, when inflated to the pressure within the correct operating pressure range, is in the range of from about one to about twenty inches greater than the width of the cover system in the absence of tension in the top and bottom covers.

It is an aspect of the present invention to provide an air mattress assembly comprising:

an air mattress, wherein the air mattress is flexible and inflatable and is capable of containing a volume of air under pressure, wherein the air mattress has a closable inlet for filing the air mattress with air, the air mattress having a top, a bottom and sides extending between the top of the air mattress and the bottom of the air mattress; and a cover system including a top cover and a bottom cover, the top cover covering the top of the air mattress, the bottom cover covering the bottom of the air mattress, the air mattress being inflated to a pressure within a correct operating pressure range for use, the top cover and bottom cover each have a length and a width before they are tensioned by inflation of the air mattress assembly to a pressure within the correct operating pressure range, wherein the air mattress has a length and a width prior to assembly with the cover system and when inflated to the pressure within the correct operating pressure range, wherein at least the width of the air mattress prior to assembly with the cover system, when inflated to the pressure within the correct operating pressure range, is greater than the width of the top cover, such that at least the top cover is in tension when the cover system is assembled with the air mattress and the air mattress assembly is inflated to the pressure within the correct operating pressure range.

It is yet another aspect of the present invention to provide an air mattress assembly according to any of the other aspects of the present invention disclosed herein, wherein the length and the width of the air mattress prior to assembly with the cover system, when inflated to the pressure within the correct operating pressure range, are greater than the length and the width, respectively, of the air mattress assembly when the air mattress assembly is inflated to the pressure within the correct operating pressure range, and wherein both the top cover and the bottom cover are in tension when the cover system is assembled with the air mattress and the air mattress assembly is inflated to the pressure within the correct operating pressure range.

It is yet another aspect of the present invention to provide an air mattress assembly according to any of the other aspects of the present invention disclosed herein, wherein the top cover has a perimeter, wherein the top cover is attached to the air mattress along the perimeter of the top cover, wherein the bottom cover has a perimeter, and wherein the bottom cover is attached to the air mattress along the perimeter of the bottom cover.

It is yet another aspect of the present invention to provide an air mattress assembly according to any of the other aspects of the present invention disclosed herein, wherein the top cover is attached to the sides of the air mattress along the perimeter of the top cover, and wherein the bottom cover is attached to the sides of the air mattress along the perimeter of the bottom cover.

These and other aspects and advantages of the present invention will be further elucidated by the following Detailed Description, drawing figures, and Claims.

BRIEF DESCRIPTION OF THE DRAWING FIGURES

DETAILED DESCRIPTION

Figure 1:
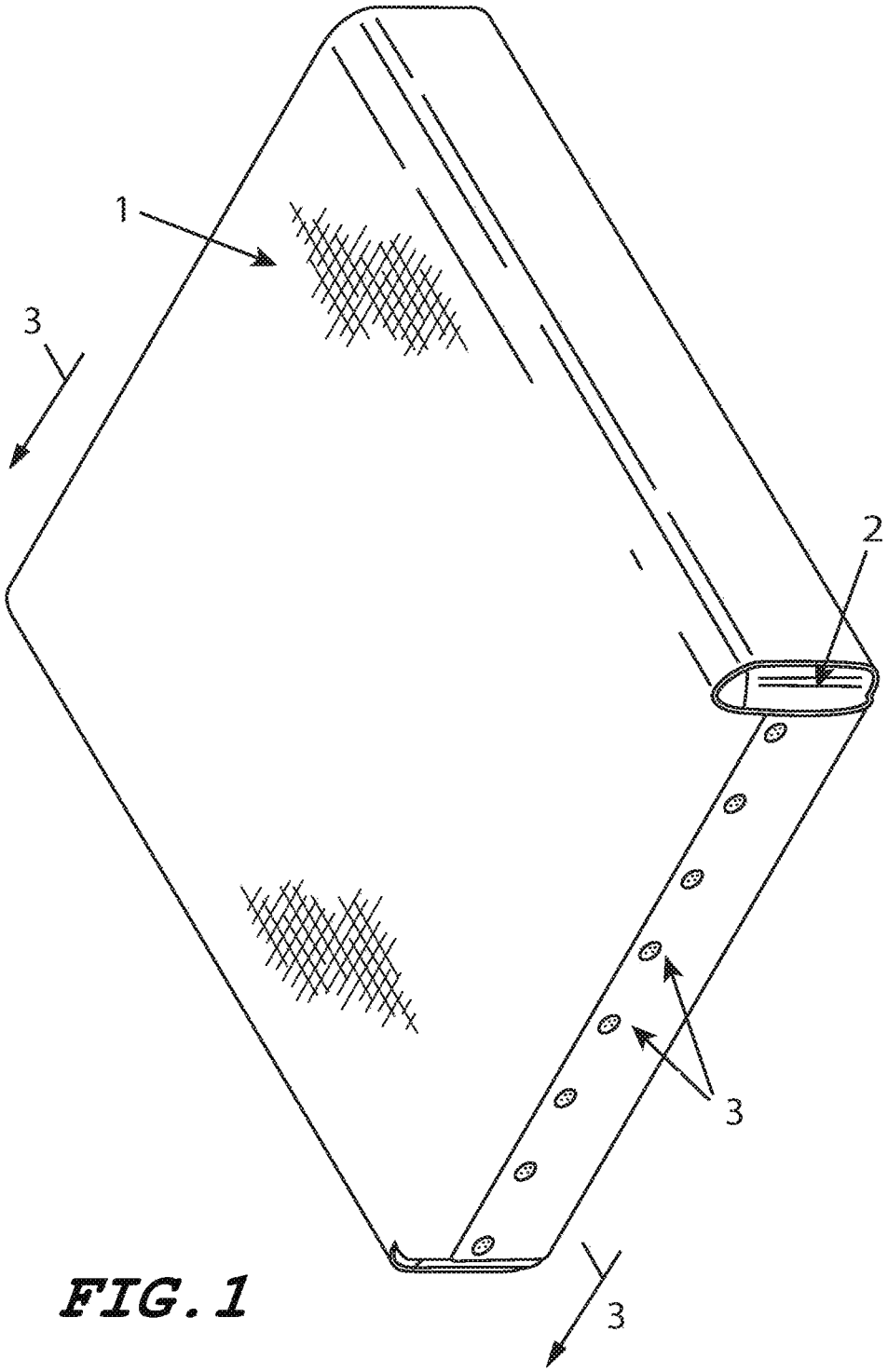
FIG. 1 shows an isometric view of a first embodiment of a mattress assembly according to the present invention.

Examples of air mattresses with tensioned top and bottom covers are described herein. The top and bottom covers become tensioned when the air mattress is fully inflated. The tension in the top and bottom covers act against each other, which stabilizes the assembly. The cover tensile resistive forces will determine how the surface of the mattress assembly feels and behaves. The connections of the covers, which are ultimately attached to a sidewall of the mattress, must be capable of resisting the equal and opposite forces due to the tension in the top and bottom covers. This can be accomplished through a series of straps, cords, or clips, which may be permanently attached to the air mattress or be removable. Alternatively, adhesives and/or welding, or any other suitable method, can be used to secure the top and bottom covers to the sidewalls of the air mattress, which will allow the covers to tension (and elongate if the cover fabric has that property) when the air mattress is inflated.

One embodiment of the air mattress assembly includes an air mattress with a raised perimeter on the top and bottom of the air mattress. Without the tensioned fabric cover, this shape for an air mattress would not be practical. The raised perimeter on the top and bottom means the majority of the mattress bottom would not touch the ground. When weight is applied, for example when a person lies on the mattress, the raised perimeter would simply collapse and allow the entire mattress bottom to contact the floor. With the added top and bottom cover, tensioned when mattress is inflated, the top cover fabric would span from perimeter to perimeter support points. It would be a balanced assembly because the same tension exists in the bottom cover creating equal and opposite forces. The top cover fabric would support the person's weight generating tension in the top and bottom covers, which would then cause lateral forces to be applied to the air mattress, through the perimeter supports, that tend to keep the raised perimeter from collapsing. This arrangement provides the added benefit of the ability to control the tension in the top and bottom covers by how much air is used to inflate the air mattress portion. Preferably, air is allowed to flow between the air mattress shell and the top and bottom covers to avoid excessive firmness due to air trapped between the top cover and the lower central majority of the top surface of the air mattress. Accordingly, it is preferable that a fabric that can breathe is used for the top cover in this embodiment. The same applies to the bottom cover.

The above-described mattress assembly has several advantages. The first is that a person lying on the air mattress assembly can adjust the tension of the mattress surface. Also, the elevated central majority of the bottom surface of the air mattress and the tensioned bottom cover fabric better isolate the person lying on the mattress from rocks and roots that may be under the mattress in camping applications.

In another embodiment, the air mattress assembly includes an air mattress having a profiled top. The profiled top of the air mattress has a bellows or accordion-like profile. The addition of a tensioned fabric on the profiled top surface will ensure that the high points of the profile will not sag excessively. The body would derive support by the high points of the air mattress as well as the tensioned fabric. This arrangement maintains the advantages of the profiled top such as allowing air circulation under the body to help with cooling and preventing excessive perspiration in hot weather and the massaging sensation provided by the high points of the profile. As with all the embodiments described herein, which use tensioned covers, the bottom cover is provided to offset or balance the tension forces created by the top cover.

A nylon/spandex fabric could be used in the above application compared to the raised perimeter mattress. Any fabric with high tensile strength properties can also be used. For example, a 100% cotton sheet could be tensioned in the same fashion. The result would be a taut top sheet/cover which would be well suited for the medical industry for eliminating bed sores. In this application, the cover system would be replaceable by the user so it can be washed.

The surface cover of the described air mattress assemblies can be just the tensioned fabric, or it may include an additional topper that can be added for additional comfort. Optionally, hook-and-loop fasteners, or other suitable means such as for example tacky adhesive pads, can be provided at various points between the air mattress surface and the inner surface of the cover sleeve to prevent the cover sleeve from slipping sliding relative to the air mattress portion of the air mattress assembly.

Another added benefit of the disclosed embodiments is that the materials and attachments described above adds tensile resistive forces and in turn structural rigidity to the entire air mattress assembly. The mattress assembly can now resist the weight of a person when only supported on the perimeter. Accordingly, the air mattress assembly can be supported by perimeter bed frame with no support slats or box spring. If a conventional air mattress was placed on such a perimeter bed frame without slats or a box spring, the added the weight of a person would cause the air mattress to fall through the bed frame. If you added the covers and then tensioned by inflating, depending on the structural tension properties of the fabric and the strength of the connections to the air mattress sidewalls, a person could easily be supported. The embodiments claimed herein provide an air mattress assembly that can span greater lengths without continuous support or closely spaced support points.

The disclosed tensioned covers are generally of two types. One type can be used as an add-on or retro-fit to an existing air mattress with known dimensions. The second type of air mattress assembly is made as a complete assembly, including both an air mattress and tensioned covers, in a manufacturing plant. With an add-on cover, there would be no positive connections or attachment points between the cover sleeve and the air mattress. With an air mattress assembly manufactured as a complete unit, the air mattress and the top and bottom covers would have integral connections or attachment points. Optionally, reinforced sidewalls can be provided for the air mattress assemblies that are manufactured as a complete assembly. Positive connection as used herein is defined as a mechanical fastener, weld or any connection that physically attaches two materials at a certain location.

Referring to FIG. 1, an assembly of an existing air mattress 2 and a retro-fitted sleeve 1 can be seen. The sleeve 1 is made of a fabric that is durable and can provide significant tension tensile force when the air mattress 2 is inflated. In some embodiments, the sleeve material will be capable of expanding. As an example, if the air mattress 2 is sixty inches wide, then the width of the top panel of the expandable fabric sleeve could be only forty inches. In this case the sleeve may expand to sixty inches in width if the properties of the fabric cover are selected to allow for this level of expansion. Depending upon the expandability of the fabric selected, the sleeve may expand to a width between sixty inches and forty inches. The same situation may apply for the length of the air mattress. A nylon/spandex fabric would be one fabric that could expand as required for this example. This arrangement provides a very taut surface for sleeping. The sleeve 1 has an opening 12 to allow the air mattress 2 to be received within the sleeve 1 before the air mattress is inflated. The opening 12 of the sleeve 1 is provided with closure flaps 13 and 14 that are secured together using buttons 3 in the illustrated embodiment. To assemble the sleeve 1 and the air mattress 2 together, the air mattress 2 is inserted into the sleeve 1, through the opening 12, before the air mattress is inflated. The flaps 13 and 14 are secured together using at least a majority of the buttons 3. Accordingly, the flaps 13 and 14 are essentially secured together before the air mattress 2 is inflated. The air mattress 2 has an air intake valve 15 that is located near one end of the opening 12 such that, with at least a majority of the buttons 3 securing the flaps 13 and 14, the air intake valve 15 can be engaged with a pump and the air mattress can be inflated. Once the air mattress is inflated to a pressure within the recommended range, the unfastened buttons 3, if any, are fastened to completely secure the flaps 13 and 14 together. The air mattress assembly is then complete and the air mattress assembly is ready for use.

The air mattress 2 can be made out of vinyl, PVC, polyethylene, thermoplastic elastomer (TPE), natural or synthetic rubber, any other suitable thermoplastic or thermosetting plastic, or any suitable polymer material with or without some degree of crosslinking.

Figure 2:
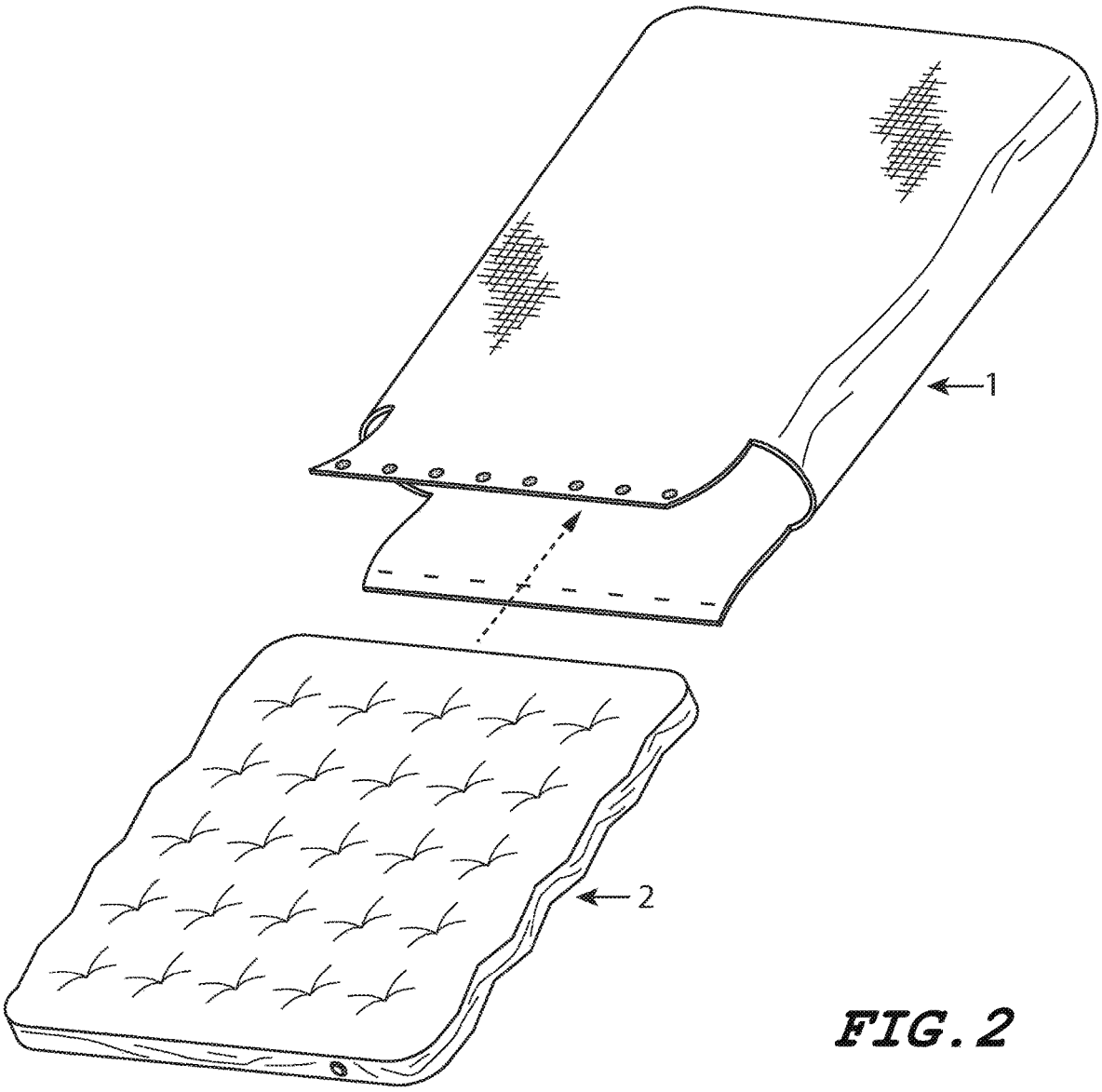
FIG. 2 shows an exploded view of the first embodiment of a mattress assembly according to the present invention as shown in FIG. 1.

FIG. 2 shows the sleeve 1 and the air mattress 2 with air intake valve 15 prior to assembly. The contour lines on the surface of the air mattress 2 indicate that the surface is not flat. The tensioned fabric of the sleeve 1 and the profiled top surface of the air mattress 2 create a new sleeping surface that provides better comfort.

Figure 3:
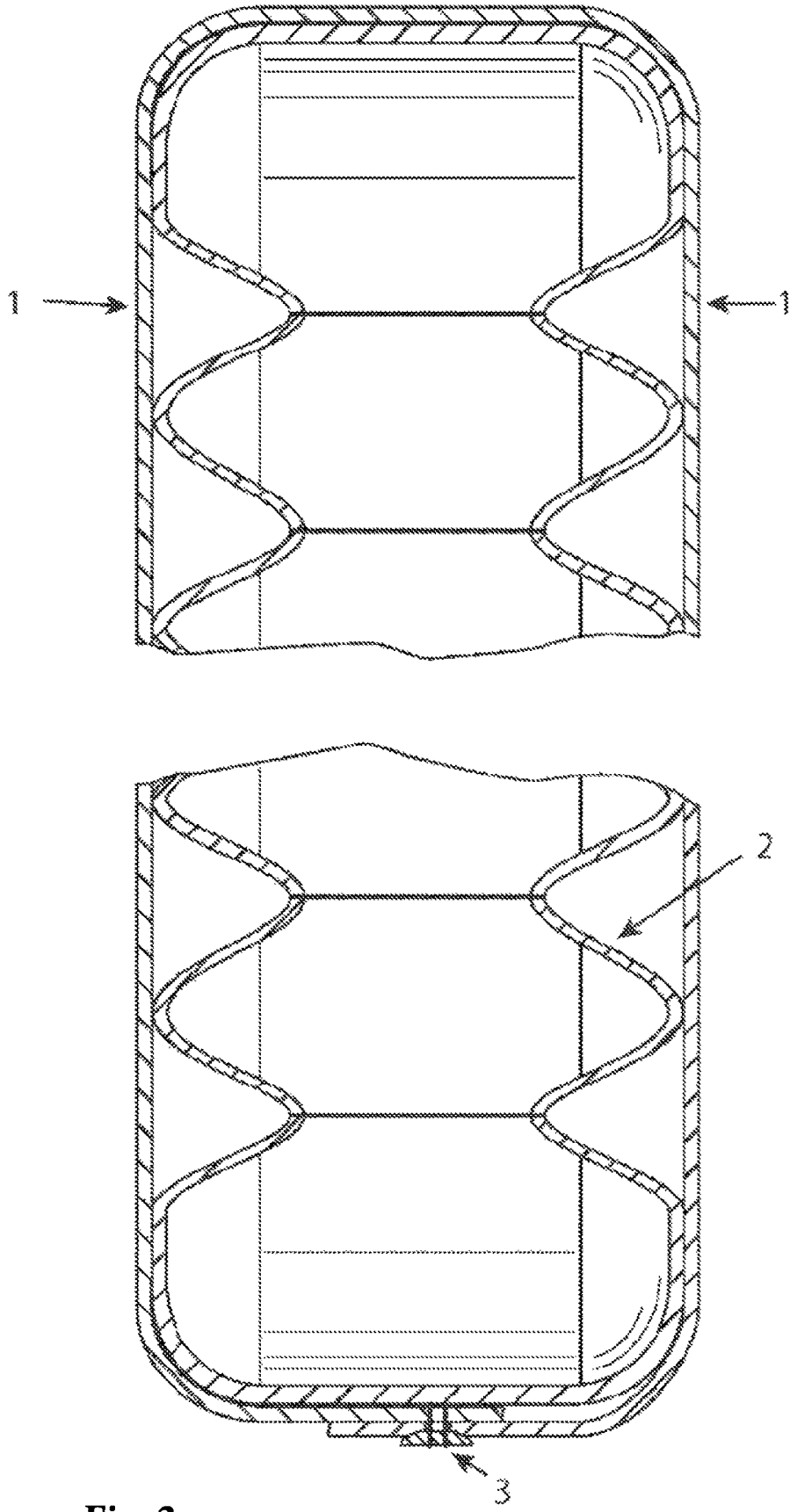
FIG. 3 shows a cross sectional view of the first embodiment of a mattress assembly according to the present invention as shown in FIG. 1 taken along the line 3-3.

FIG. 3 shows a section cut 3-3 of the air mattress assembly of FIG. 1. It is worth noting that the profile of the air mattress 2 is shown to have a very deep low point relative to the high points for the profile of both the top and the bottom surface of the air mattress 2. It has been found that the more deeply profiled the air mattress surface is, the better the tensioned sleeve 1 will perform to provide comfort to the user.

Figure 4:
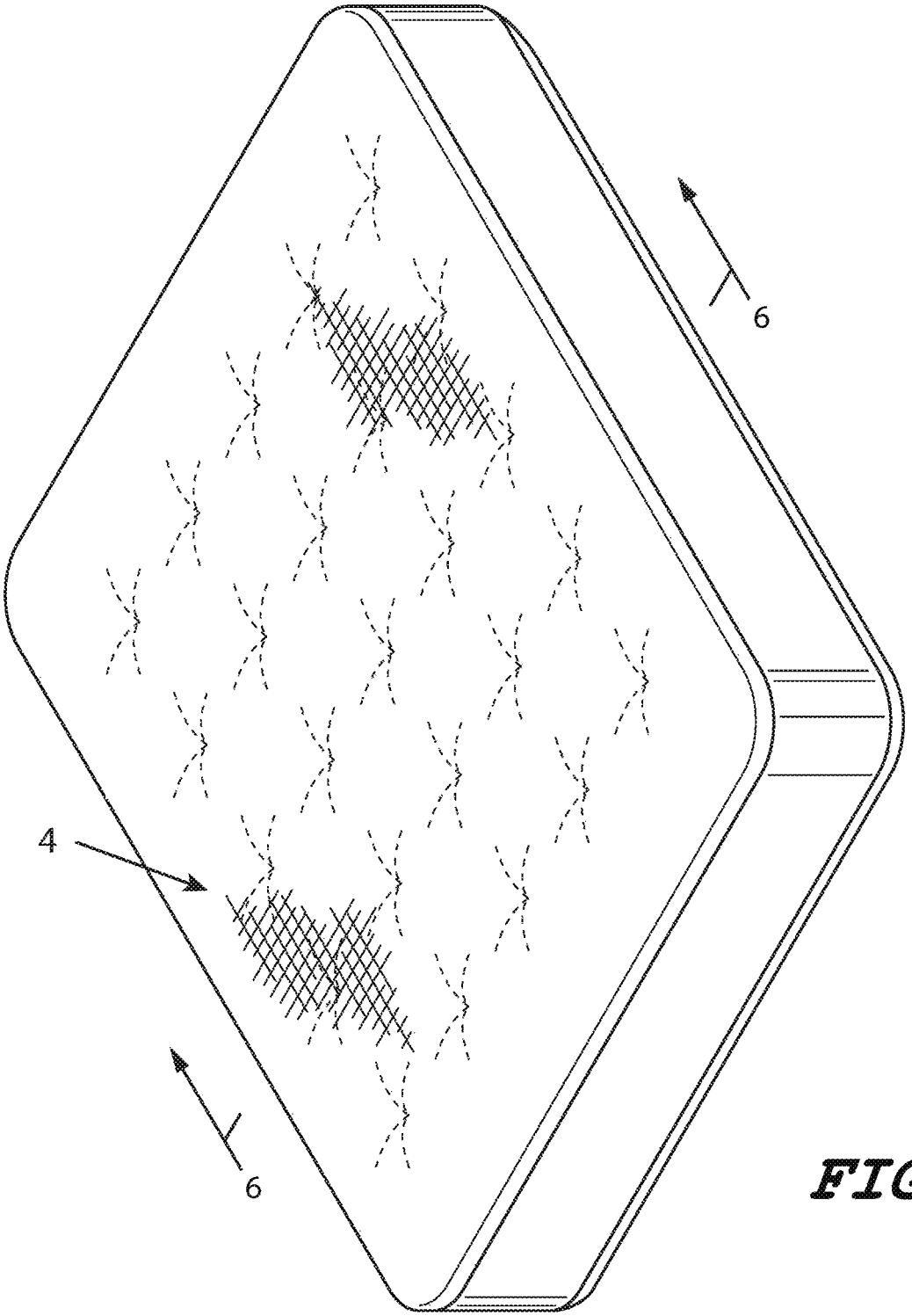
FIG. 4 shows an isometric view of a second embodiment of a mattress assembly according to the present invention.
Figure 5:
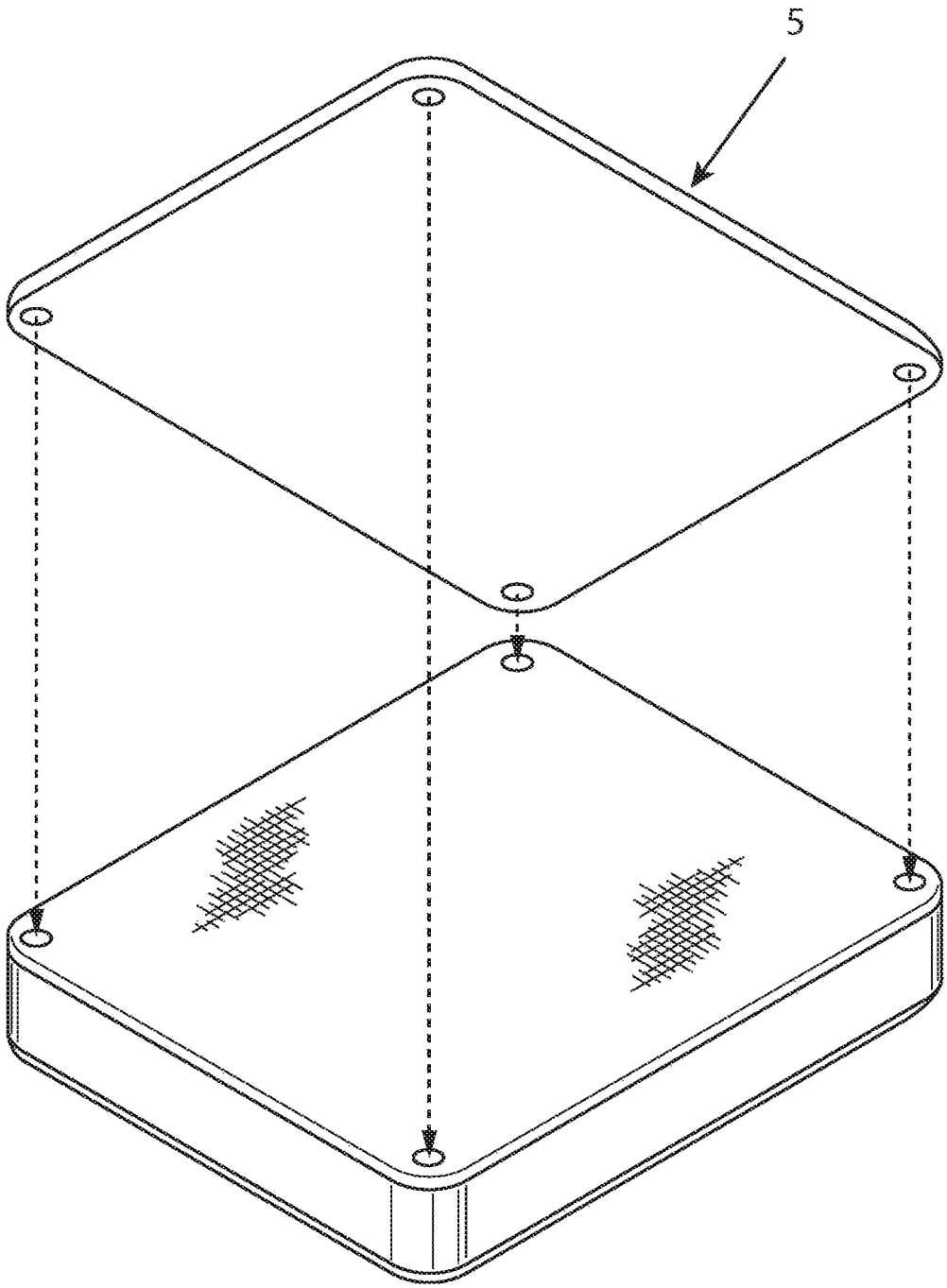
FIG. 5 shows a partially exploded view of the second embodiment of a mattress assembly according to the present invention as shown in FIG. 4, showing the optional pillow top or topper removed from the air mattress assembly.
Figure 6:
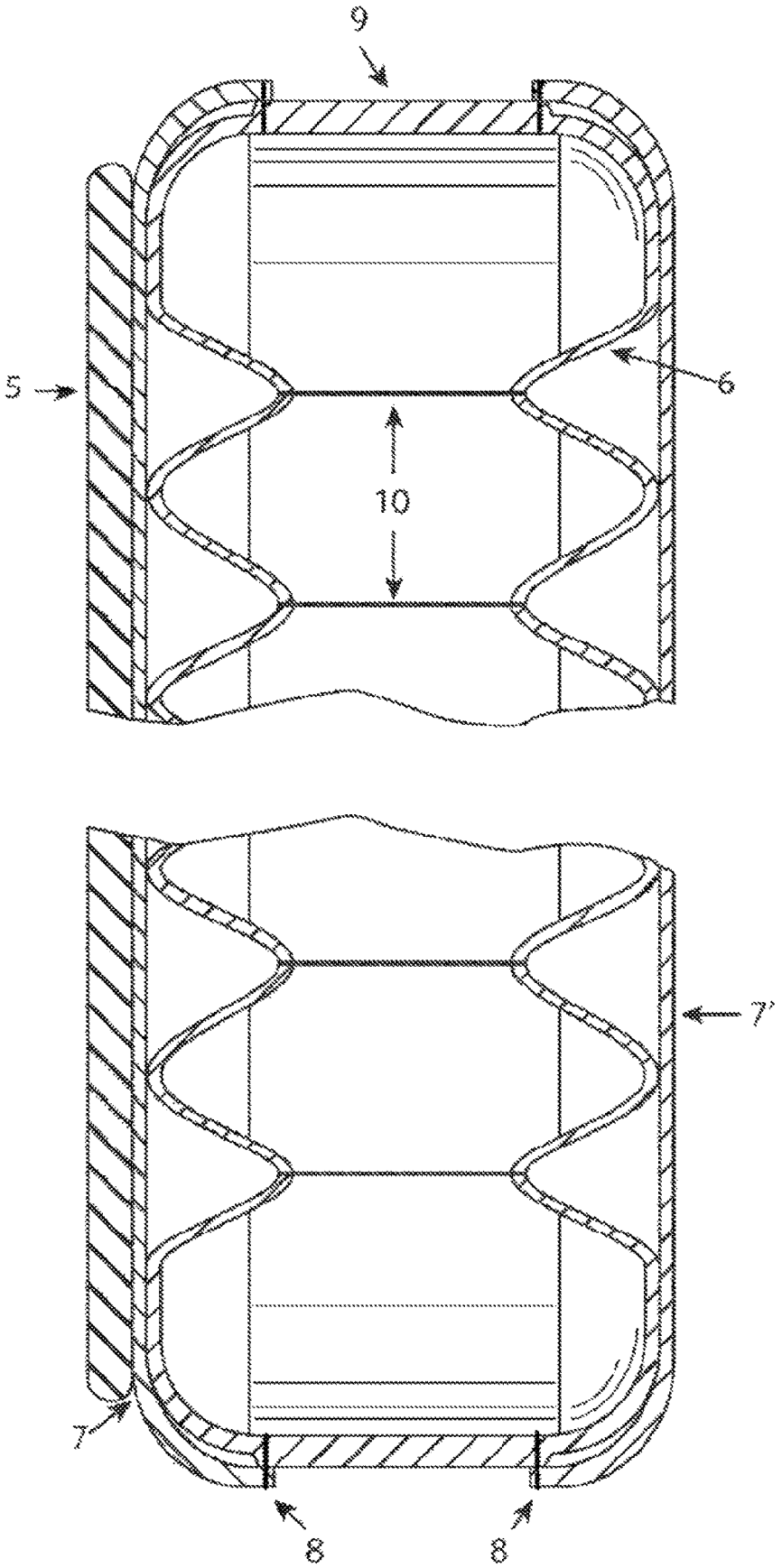
FIG. 6 shows a cross sectional view of the second embodiment of a mattress assembly according to the present invention as shown in FIG. 4 taken along the line 6-6.

Referring to FIGS. 4-6, an embodiment of the air mattress assembly having a tensioned cover system 4 that includes a top tensioned fabric 7 and a bottom tensioned fabric 7' can be seen. The top tensioned fabric 7 and the bottom tensioned fabric 7' can best be seen in FIG. 6. This embodiment of the air mattress assembly would be fully manufactured and sold as one unit.

Referring to FIG. 5, an optional cushion or pillow topper 5 for the air mattress assembly can be seen. One way to secure the topper 5 to the mattress is with hook-and-loop fasteners, such as the type available under the trademark VELCRO®, which are depicted as circular patches in the drawing.

FIG. 6 shows a section cut through line 6-6 of FIG. 4. As illustrated in FIG. 6, the sidewalls 9 of the air mattress are thickened to better withstand the stresses of anchoring the perimeter of the top and bottom covers 7 and 7', respectively. Reinforcement of the sidewalls using the thicker material is preferred in order to handle the equal and opposite forces the top and bottom fabric covers 7, 7' exert on the sidewalls. These forces are resisted by the sidewalls and the overall structure of the inflated mattress. In the illustrated example, the top and bottom covers 7 and 7' are positively connected to the sidewalls 9 along their perimeter using embedded anchors 8. The surface 6 of the air mattress 2' that is inflated is again shown to have a profile with low and high points. The air mattress 2' may have internal connecting walls 10 connected and extending between the top and bottom of the air mattress. The connecting walls 10 pull the top and bottom of the air mattress together at the low points of the profile of the top and bottom of the air mattress in order to help maintain the profile of the top and bottom of the air mattress. The width and length of the top and bottom fabric covers 7 and 7' before tensioning is less than the inflated width and length of the air mattress in the absence of the covers or cover system. Depending on the properties of the cover fabric used in the top and bottom covers 7, 7', the width and length of cover fabric before tensioning can be significantly less than the inflated width and length of the air mattress in the absence of the cover system.

Figure 7:
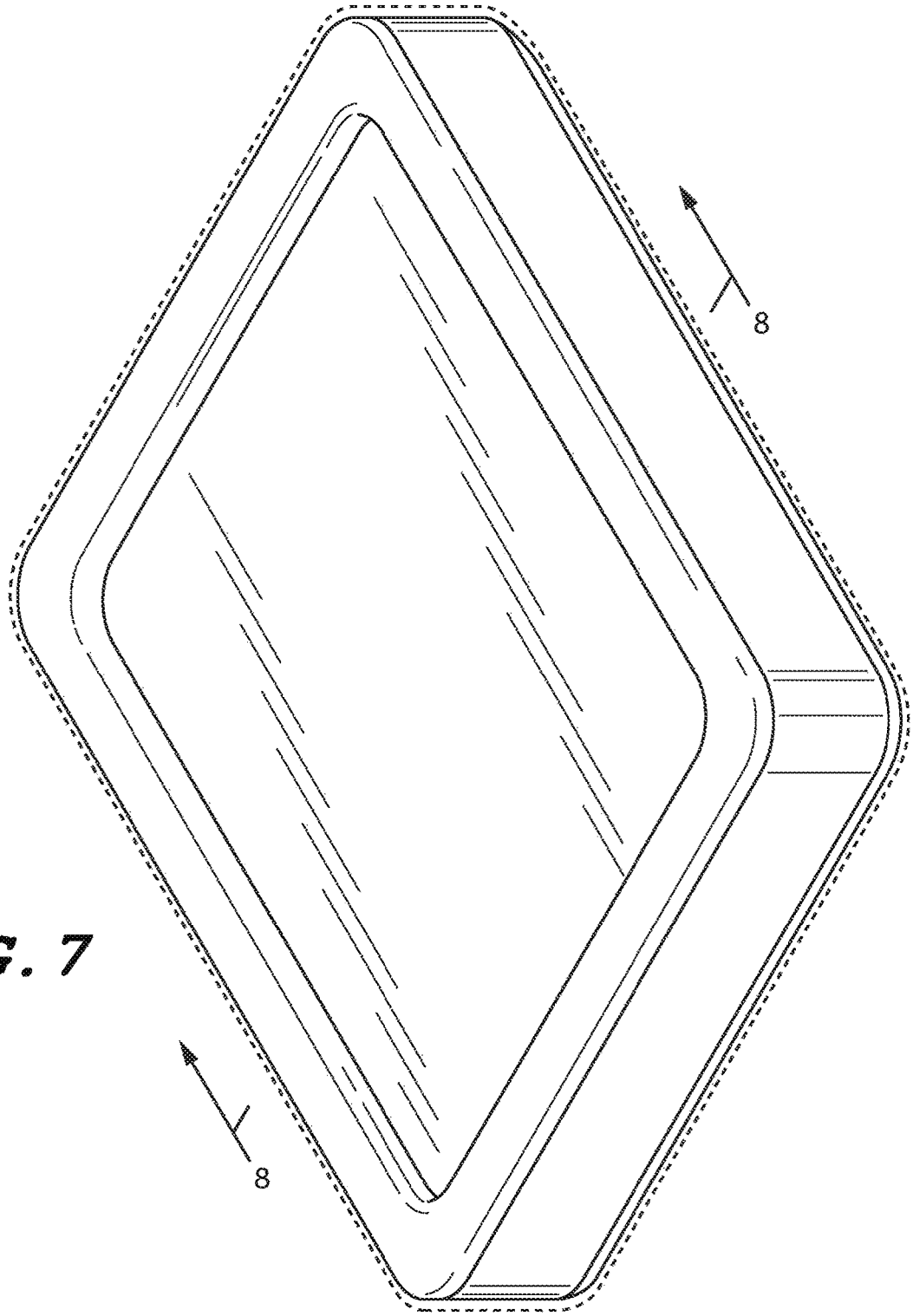
FIG. 7 shows an isometric view of a third embodiment of a mattress assembly according to the present invention with the top and bottom covers shown in dashed lines to reveal the shape of the air mattress.
Figure 8:
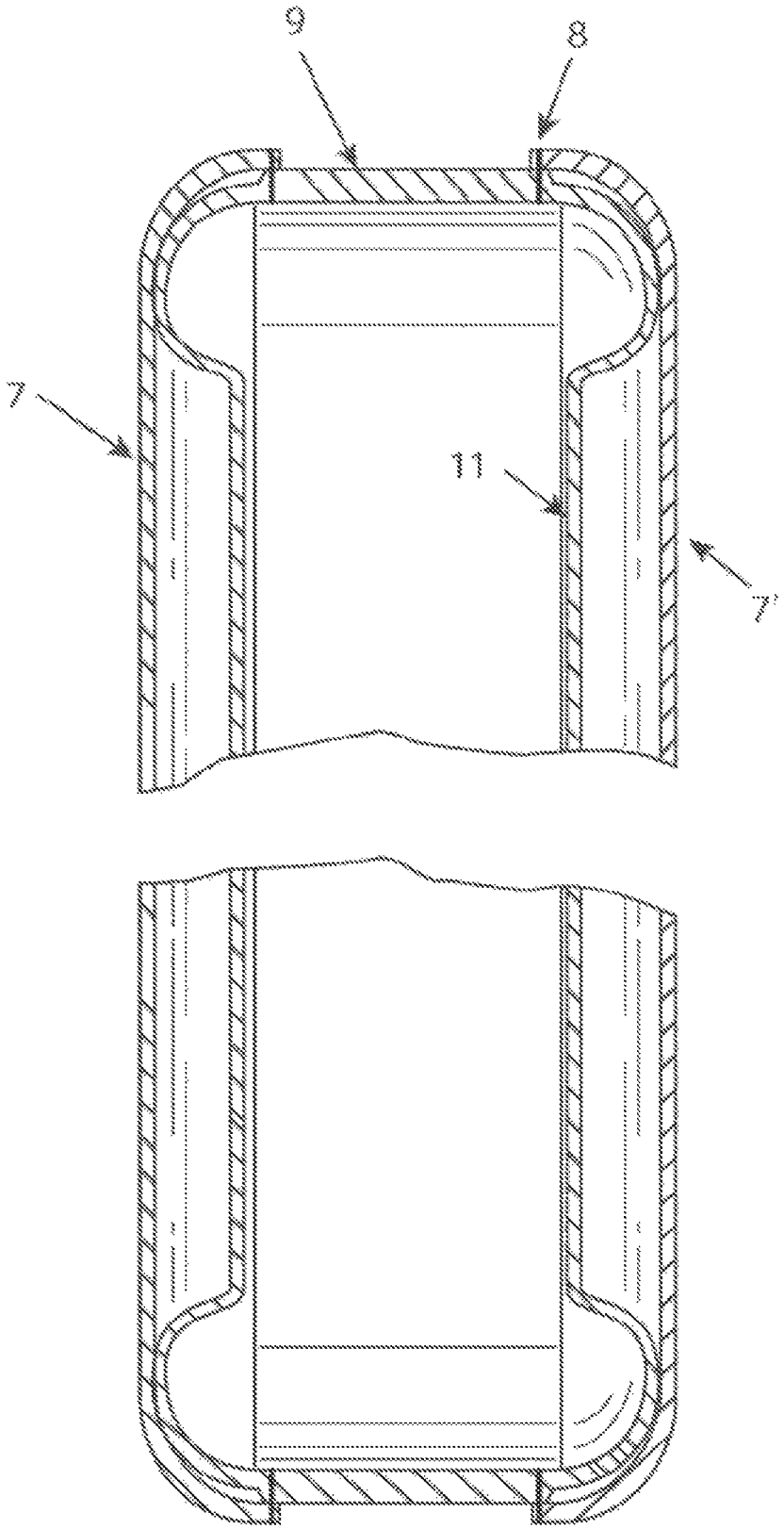
FIG. 8 shows a cross sectional view of the third embodiment of a mattress assembly according to the present invention as shown in FIG. 7 taken along the line 8-8 with the top and bottom covers shown in solid lines and with cross hatching.
Figure 9:
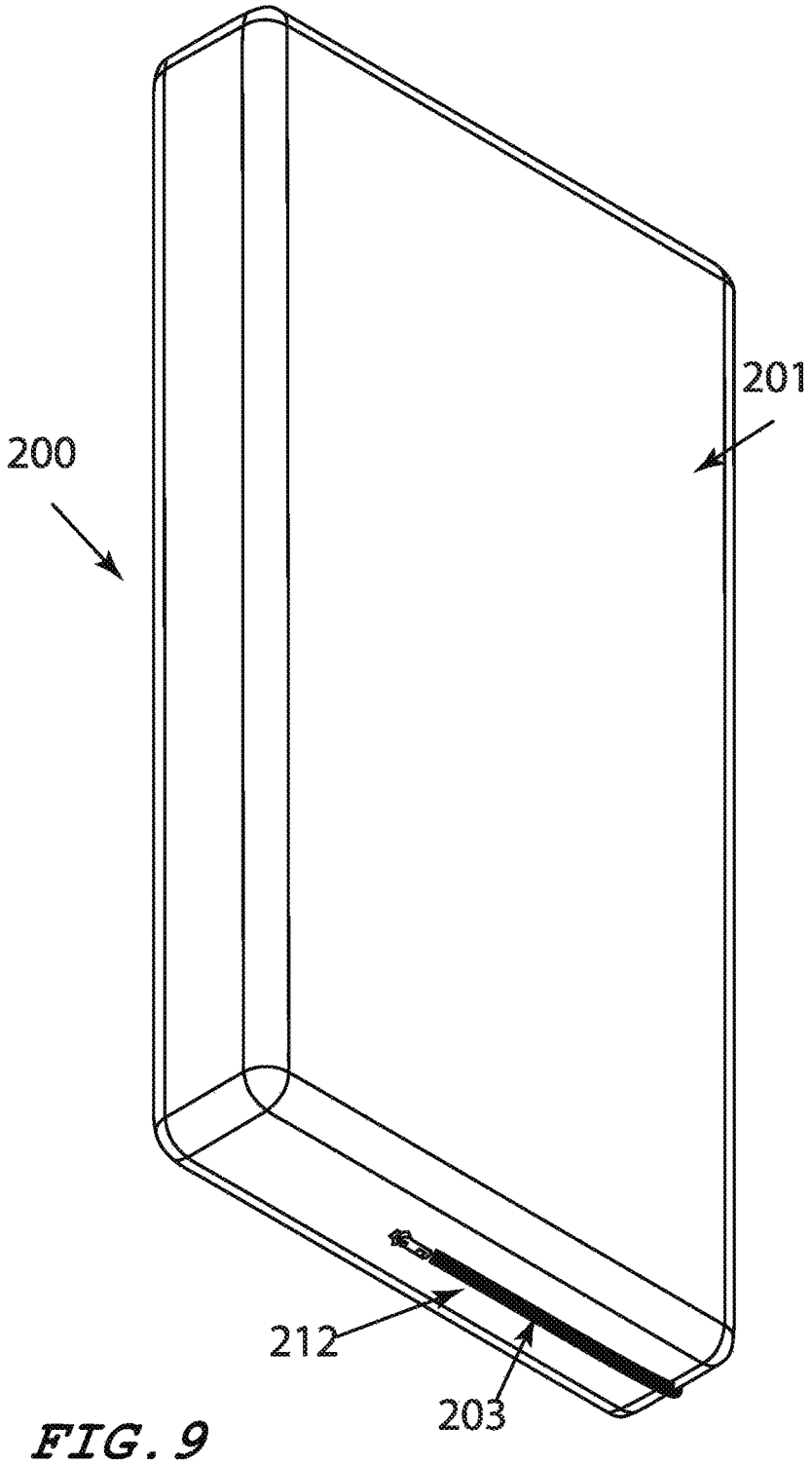
FIGS. 9-12 show views of the fourth embodiment of a mattress assembly according to the present invention.
Figure 10:
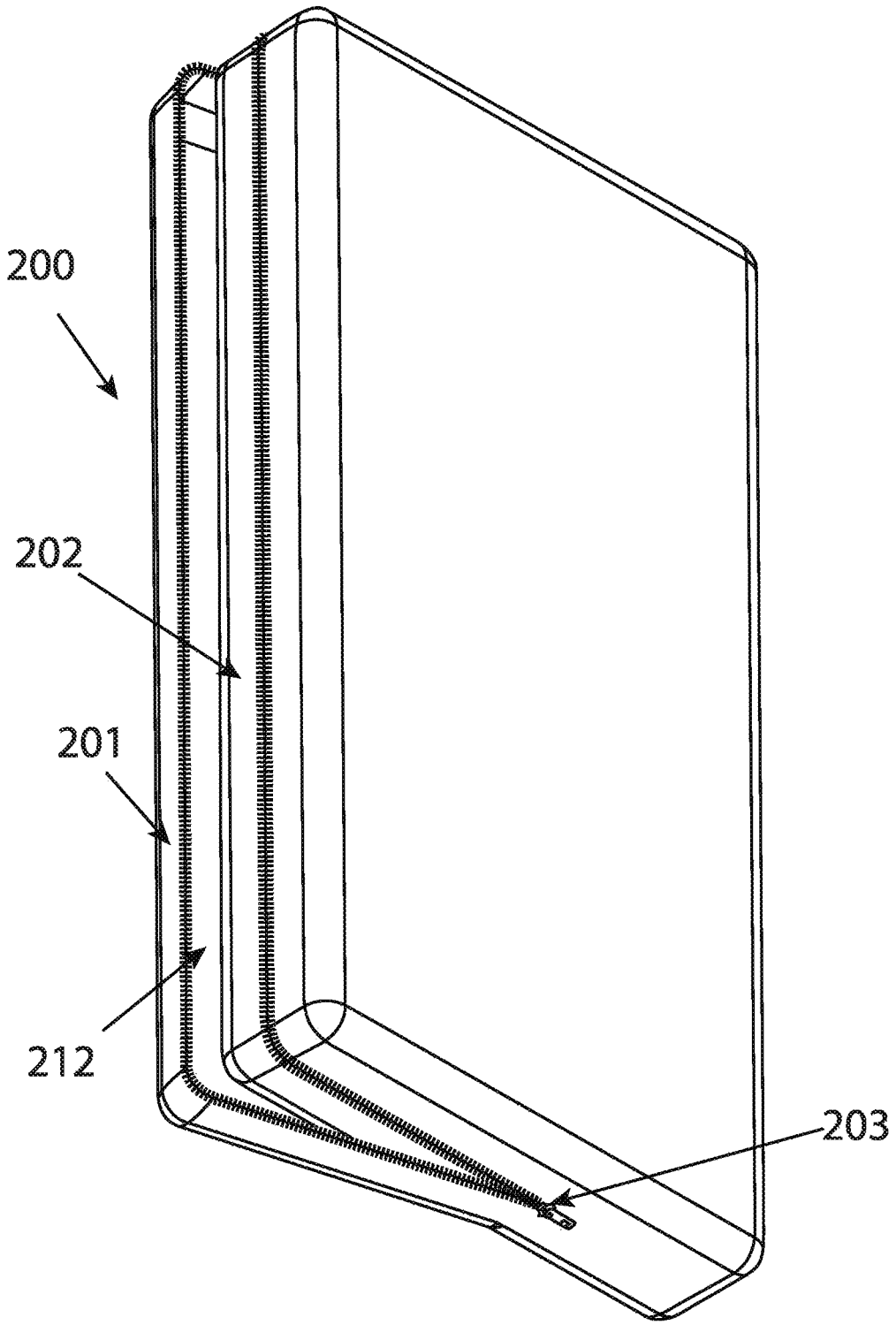
Figure 11:
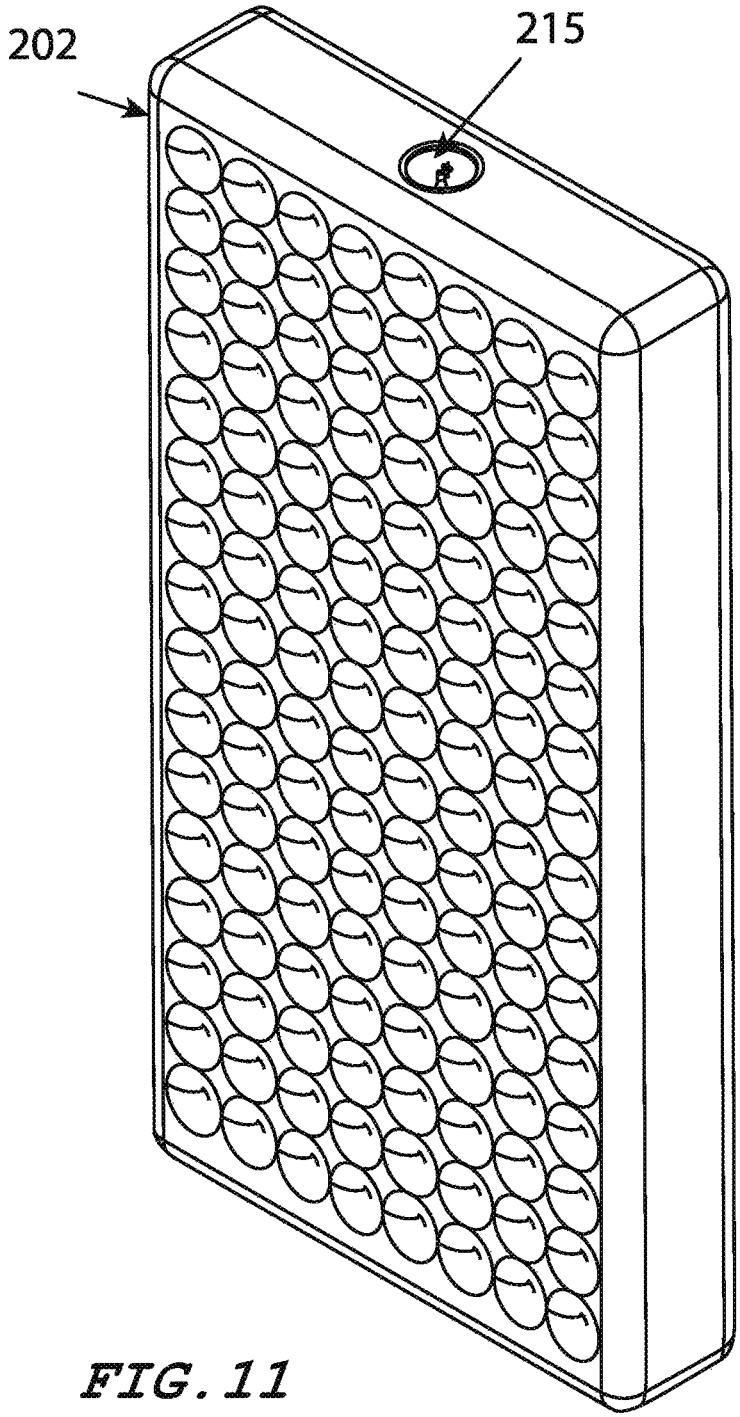
Figure 12:
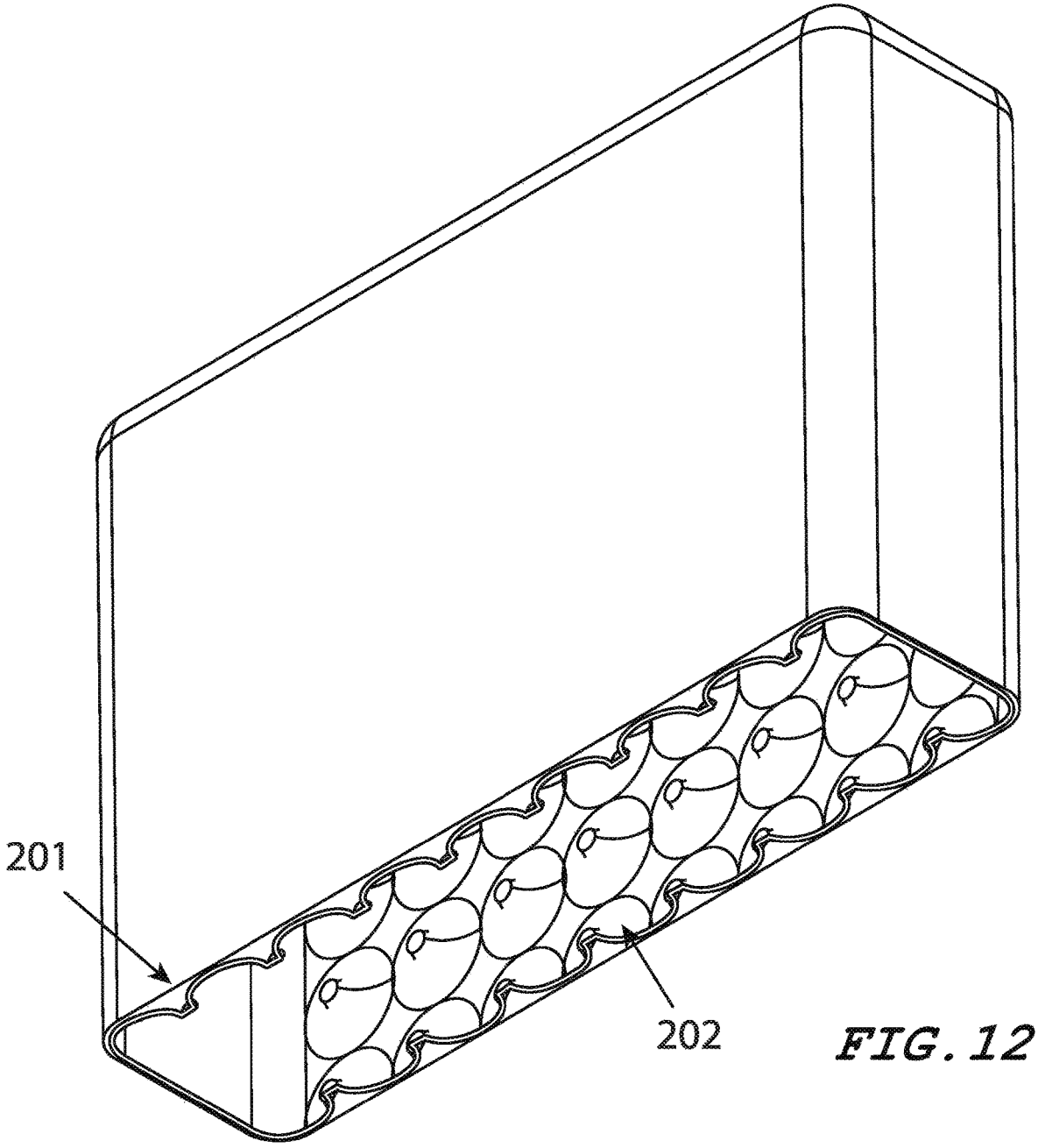

FIGS. 7 and 8 show yet another embodiment of the present invention. The air mattress has a raised perimeter on the top and the bottom. The hatching indicates that the tensioned top and bottom cover material 7 and 7', which can be made of cotton, linen, polyester, polyethylene, nylon, and other sufficiently strong woven fabrics, is shown in cross section.

FIG. 8 is a cross section taken along the cut line 8-8 of FIG. 7. The air mattress assembly of FIGS. 7-8 is similar in concept to the embodiment of FIG. 6. There are two primary differences however. The bottom of the air mattress is raised off the ground. Also, the body of the person lying on the air mattress assembly is raised off the top of the air mattress. These effects are due to the raised perimeter on the top and the bottom of the air mattress. This arrangement provides a cooler and more comfortable feel or experience for the person lying on the air mattress assembly with less perspiration in hot weather. Without the top and bottom tensioned fabric covers 7 and 7' the mattress would not support the weight of a person. It would simply collapse to the ground assuming it was directly placed on the ground, for example in a camping application. The amount of air pressure inside the mattress can be used to vary or determine how taut the cover fabrics become within a practically useful range of fabric cover tension. This is true of all the claimed air mattress assemblies.

The sleeve 1 has at least four sides. Preferably the sleeve 1 is six sided as shown in the drawing. Materials that are easily stretchable are not at present the preferred choice for use in the cover system. Such material may expand after several uses and not return to its original dimensions in its un-deformed state. A test sleeve made of a spandex/nylon hybrid fabric having an original width of thirty five inches expanded to thirty eight inches wide in its un-deformed state. The test sleeve lost its tension properties when the air mattress assembly was fully inflated and lying on the air mattress assembly with this test sleeve felt essentially like lying on an air mattress with no sleeve.

Accordingly, it is preferred that the material used for the cover system does not stretch. All materials, having a finite modulus of elasticity, stretch under a tensile force. However, non-stretch fabric is a term of art used in the textile industry. Such fabrics include fabrics made of yarns that stretch ten percent or less at maximum load. In contrast, stretch fabrics or elastic materials can be stretched eighty five to one hundred percent and then return to their original shape. Non-stretch material or fabric as used herein refers to material that shows no practically significant or appreciable stretching during the normal intended use of the disclosed air mattress assemblies.

The panels or sheets of material used to form the top cover, bottom cover, and the sidewalls of the cover system should always have dimensions, such as length, width, and height, that are smaller than corresponding dimensions of panels or sheets of material that form the top bottom and sides of the air mattress.

One example of the present air mattress assemblies uses an air mattress having the dimensions of sixty inches by eighty inches by eight and three quarter inches, while the sleeve has dimensions of fifty seven inches by seventy nine inches by five inches. The material used for the sleeve in this example is a polyester/cotton canvas fabric with no noticeable stretch factor.

Preferably the non-stretch materials used in the present invention stretch twenty five percent or less at maximum load. More preferably, the non-stretch materials used in the present invention stretch ten percent or less at maximum load.

In some embodiments, the fabric for the top and bottom covers can be secured to the sides or sidewalls of the air mattress by using welding or adhesive either directly or through the use of a sealing strip placed over the edge of the cover fabric. In addition, welting cord may be used for added strength and reinforcement. The sealing strip can be welded or cemented to the air mattress material through perforations provided in the cover along the perimeter of the cover. Alternatively, glue, cement, or other adhesive can saturate the cover material and bond the sealing strip to the air mattress material.

Using a six sided sleeve avoids some of the manufacturing complexities of the bonded cover systems, and the six sided sleeve can be just as effective. The six sided sleeve can be removed and washed if needed, and no positive connection is required to the air mattress portion.

A greater comfort level can be achieved, and the person lying on the air mattress assembly prevented from sinking uncomfortably far into the air mattress, by providing tensioned top and bottom covers acting on the top and bottom sides, respectively, of an air mattress. This arrangement obviates the need for any outside apparatus, such as tensioners connecting the top cover to a bed frame, for creating tension in the top cover.

An air mattress with the tensioned sleeve is more comfortable due to the body being elevated by the fabric or top cover, while still providing sufficient cushioning or give for comfort. A pillow or cushioned topper can be added to the top cover to adjust the firmness or softness of the air mattress assembly. For example, a one inch cushioned topper can be used for a relatively firm feel, a two inch cushioned topper can be used for a medium feel, and a three inch cushioned topper can be used for a relatively soft feel. The air mattress assembly according to the claimed embodiments avoids one of the biggest problems associated with standard mattresses, namely, that it does not sink or sag in the middle.

Referring to FIGS. 9-12, yet another embodiment 200 of the invention can be seen. The air mattress assembly 200 is similar to the air mattress assembly of FIGS. 1-3 except for the differences noted below.

The air mattress assembly 200 includes an air mattress 202 a sleeve 201. The sleeve 201 is made of a fabric that is durable and can provide significant tension tensile force when the air mattress 202 is inflated. The same types of materials that were mentioned with respect to the sleeve 1 and the top and bottom cover material 7 and 7' will also be suitable for the sleeve 201. The opening 212 of the sleeve 201 is provided with a slide fastener 203, commonly referred to as a zipper, which can be used to close off the opening 212 or to open the opening 212 for the insertion and removal of the uninflated air mattress into or from the sleeve 201. Accordingly, the zipper 203 replaces the buttons 3 in the sleeve 201. Also, the closure flaps 13 and 14 are replaced by a simple slit defining the opening 212 in the sleeve 201. In the illustrated embodiment, the slit defining the opening 212 and the zipper 203 extend over a first side, preferably one of the longer sides, of the sleeve 201 or the air mattress assembly 200 and over portions of two other sides of the sleeve or air mattress assembly that are adjacent to the first side.

Alternatively, the slit defining the opening 212 and the zipper 203 may extend over a portion of the length of a side of the sleeve 201 or the air mattress assembly 200, or the slit defining the opening 212 and the zipper 203 may extend over essentially the entire length of a side of the sleeve 201 or the air mattress assembly 200.

To assemble the sleeve 201 and the air mattress 202 together, the air mattress 202 is inserted into the sleeve 201, through the opening 212, before the air mattress is inflated. The zipper 203 is then moved the majority of the way to the closed position such that only a small opening that is large enough to allow access to the air intake valve 215 is left. Accordingly, the edges of the opening 212 are essentially secured together before the air mattress 202 is inflated. The air mattress 202 has an air intake valve 215 that is located near one end of the opening 212 such that, with at least a majority of the opening 212 closed by the zipper 203, the air intake valve 215 can be engaged with a pump and the air mattress can be inflated. Once the air mattress is inflated to a pressure within the recommended range, the remainder of the opening 212 is closed by moving the slide of the zipper 203 completely to the closed position. The air mattress assembly 200 is then complete and the air mattress assembly 200 is ready for use. The air mattress 202 can be made of the same material as the air mattress 2.

The air mattress 202, as illustrated in FIGS. 9-12, has top and bottom surfaces that are profiled to have high and low points, illustrated diagrammatically, as is the case with the air mattress 2. However, an air mattress that does not have profiled top and bottom surfaces may also be used in combination with the sleeve 201 and is contemplated as being within the scope of the present invention. As has been previously stated, it may be more advantageous to use an air mattress having deeply profiled top and bottom surfaces because the more deeply profiled air mattress surfaces will allow the tensioned sleeve to perform better and provide better comfort to the user.

Figure 13:
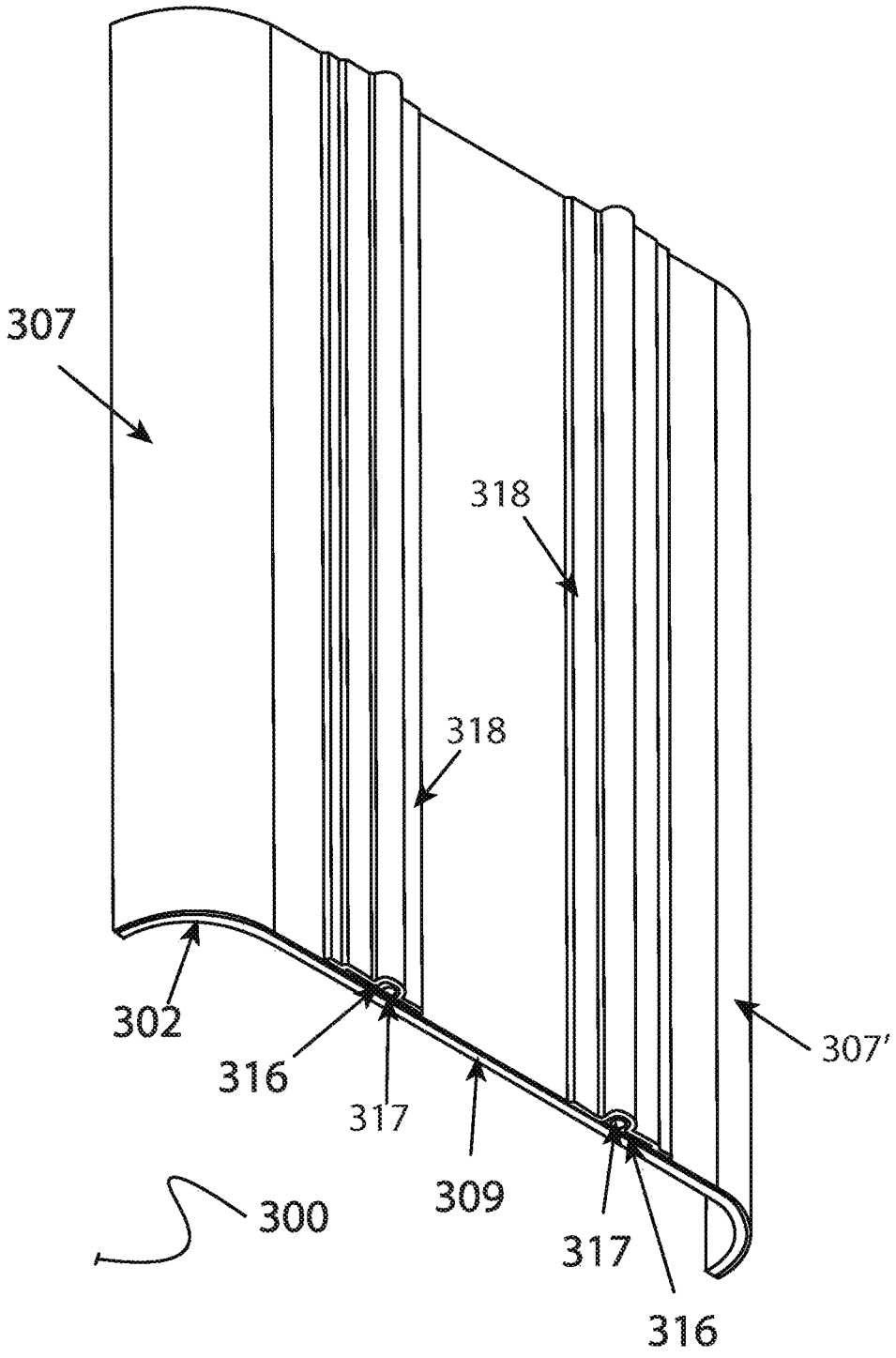
FIG. 13 shows a fragmentary view of the fifth embodiment of a mattress assembly according to the present invention.

Referring to FIG. 13, a fragmentary view of an air mattress assembly 300 can be seen. The air mattress assembly 300 is generally similar to the air mattress assembly of FIGS. 4-6; the only difference being in the structure used for attaching the top cover 307 and the bottom cover 307' to the air mattress 302. In the example of FIG. 13, the edge portions of each of the top and bottom covers 307 and 307' are folded over to form a channel 316 for the cord 317 for each of the top and bottom covers. The channel 316 and the cord 317 are substantially coextensive with the perimeter of the corresponding top and bottom cover 307 or 307', which means that each of the channels 316 and the cords 317 extend along the majority of the length of the four sides of the corresponding one of the top and bottom covers 307 and 307'. Preferably, the channel 316 and the cord 317 are essentially coextensive with the perimeter of the corresponding top and bottom cover 307 or 307'.

Each of the top and bottom covers 307 and 307' is also provided with a sealing strip 318 that is attached to the sidewall 309 of the air mattress 302 on one side of the corresponding cord 317 and channel 316. The sealing strip 318 can be attached to the sidewall 309 of the air mattress 302 by any suitable method including, for example, ultrasonic welding, heat fusion, cementing, and gluing or using adhesives. Each sealing strip 318 then extends over and covers the corresponding channel 316 and cord 317 and is attached to the air mattress 302 or the sidewall 309 of the air mattress 302 by glue/adhesive to anchor the corresponding top or bottom cover to the air mattress 302. The glue/adhesive saturates the corresponding top or bottom cover to attach the corresponding sealing strip to the air mattress 302 or the sidewall 309 of the air mattress 302 through the corresponding top or bottom cover. Preferably, each sealing strip 318 is essentially coextensive with the perimeter of the corresponding top or bottom cover 307 or 307'. Alternatively, each sealing strip 318 may extend along portions of the four sides of the air mattress assembly 300. Each sealing strip 318 may be continuous or may be provided in segments along the perimeter of the air mattress assembly 300. Preferably, each sealing strip 318 extends at least along a majority of the length of each of the four sides of the air mattress assembly 300.

Figure 14:
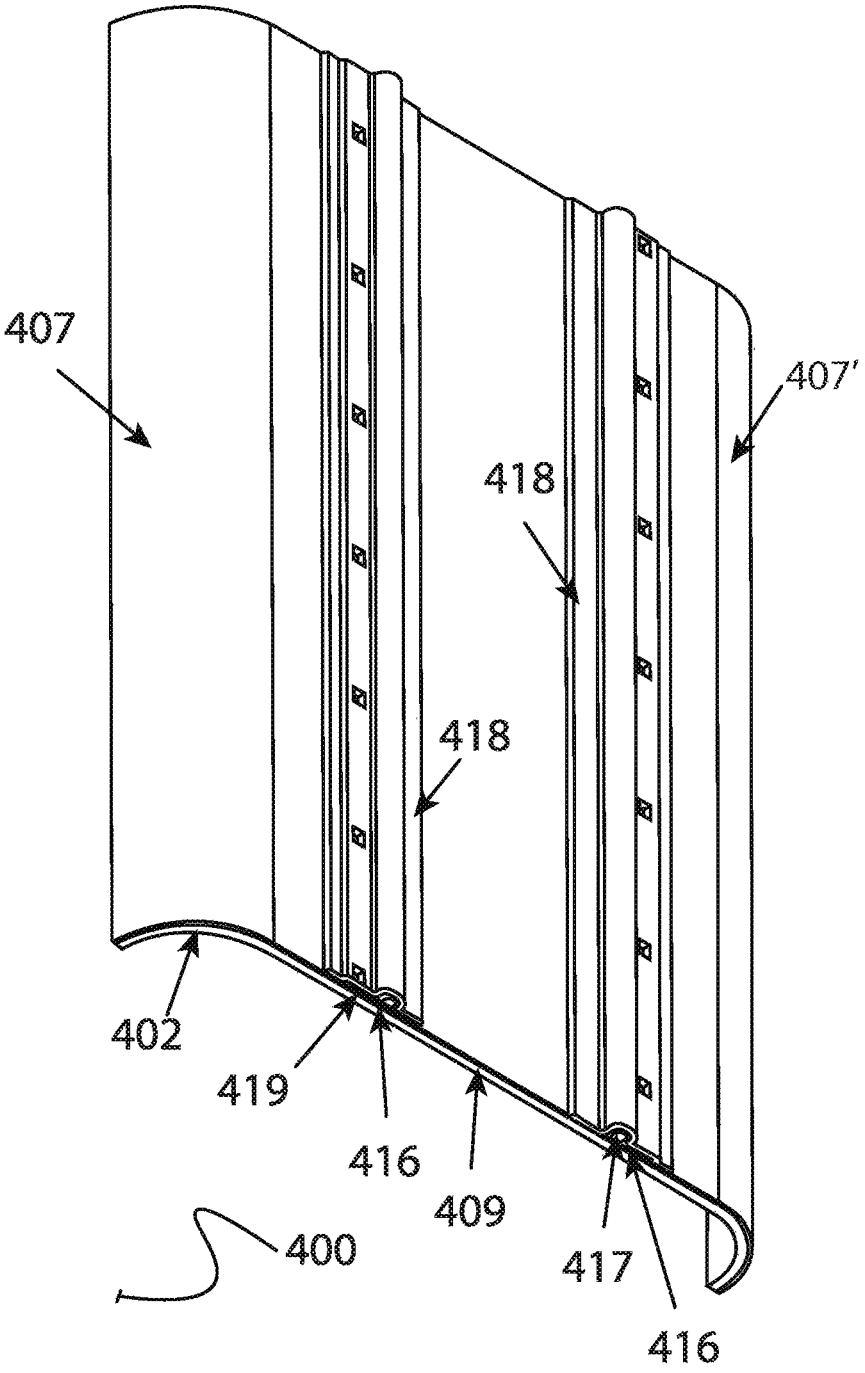
FIG. 14 shows a fragmentary view of the sixth embodiment of a mattress assembly according to the present invention.

Referring to FIG. 14, a fragmentary view of an air mattress assembly 500 can be seen. The air mattress assembly 500 is generally similar to the air mattress assembly of FIG. 13; the only difference being in the structure used for attaching the top cover 407 and the bottom cover 407' to the air mattress 402. In the example of FIG. 14, the edge portions of each of the top and bottom covers 407 and 407' are folded over to form a channel 416 for the cord 417 for each of the top and bottom covers. The channel 416 and the cord 417 are substantially coextensive with the perimeter of the corresponding top and bottom cover 407 or 407', which means that each of the channels 416 and the cords 417 extend along the majority of the length of the four sides of the corresponding one of the top and bottom covers 407 and 407'. Preferably, the channel 416 and the cord 417 are essentially coextensive with the perimeter of the corresponding top and bottom cover 407 or 407'.

Each of the top and bottom covers 407 and 407' is also provided with a sealing strip 418 that is attached to the sidewall 409 of the air mattress 402 on one side of the corresponding cord 417 and channel 416. The sealing strip 418 can be attached to the sidewall 409 of the air mattress 402 by any suitable method including, for example, ultrasonic welding, heat fusion, cementing, and gluing or using adhesives. Each sealing strip 418 then extends over and covers the corresponding channel 416 and cord 417 and is attached to the air mattress 402 or the sidewall 409 of the air mattress 402 by any suitable method through perforations or windows 419 provided in the top and bottom covers to anchor the corresponding top or bottom cover to the air mattress 402. The windows 419 are distributed along portions, or all, of the perimeter of the top and bottom covers. The attachment between each sealing strip 418 and the air mattress 402, through the windows 419, may be accomplished by any suitable method including, for example, ultrasonic welding, heat fusion, cementing, and gluing or using adhesives. The attachment between each sealing strip 418 and the air mattress 402, through the windows 419, may be used in place of, or in addition to, the glue/adhesive saturating the corresponding top or bottom cover to attach the corresponding sealing strip to the air mattress 402. Otherwise, the remarks regarding the embodiment of FIG. 13 are equally applicable to the embodiment of FIG. 14, and in all other respects, the embodiment of FIG. 13 and the embodiment of FIG. 14 are identical.

Figure 15:
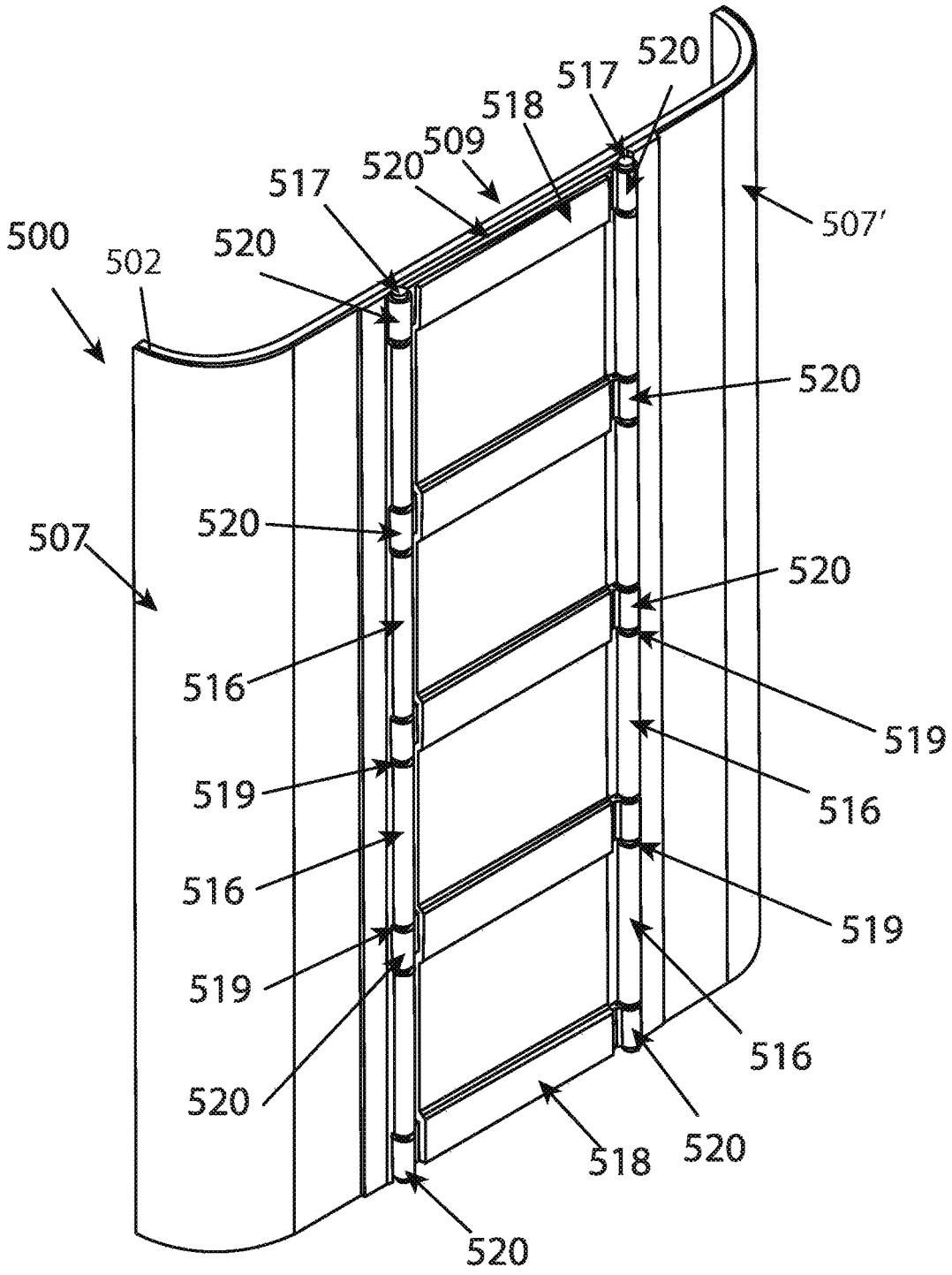
FIG. 15 shows a fragmentary view of the seventh embodiment of a mattress assembly according to the present invention.

Referring to FIG. 15, a fragmentary view of an air mattress assembly 500 can be seen. The air mattress assembly 500 is generally similar to the air mattress assembly of FIGS. 13 and 14; the only difference being in the structure used for attaching the top cover 507 and the bottom cover 507' to the air mattress 502. In the example of FIG. 15, the edge portions of each of the top and bottom covers 507 and 507' are folded over to form a channel 515 for the cord 517 for each of the top and bottom covers. The channel 515 and the cord 517 are substantially coextensive with the perimeter of the corresponding top and bottom cover 507 or 507', which means that each of the channels 515 and the cords 517 extend along the majority of the length of the four sides of the corresponding one of the top and bottom covers 507 and 507'. Preferably, the channel 515 and the cord 517 are essentially coextensive with the perimeter of the corresponding top and bottom cover 507 or 507'.

Each of the channels 515 is provided with a plurality of cutouts 519 that expose portions of the corresponding cord 517. A number, and preferably most or all, of the exposed portions of the cord 517 for the top cover 507 are then connected to corresponding exposed portions of the cord 517 for the bottom covers 507' by corresponding ties or tethers 520 to hold the top and bottom covers 507 and 507' around the air mattress 502. This arrangement allows the tension in the top cover to be counterbalanced by the tension in the bottom cover and relieves some or most of the stress imparted to any attachment between the top and bottom covers 507 and 507' and the air mattress 502. The air mattress assembly 500 is also provided with a sealing strip 518 that covers at least a portion of the ties 520 extending along the sidewall 509 of the air mattress 502. The sealing strip 518 is attached to the sidewall 509 of the air mattress 502 intermediate the ties 520 in the same manner as the sealing strips of the embodiments of FIGS. 13 and 14. The sealing strip 518 secures the ties 520 in place on the sidewall of the air mattress 502 and thus prevents the ties 520 and the top and bottom covers 507 and 507' from shifting relative to the air mattress 502.

The cutouts 519 are distributed along portions, or all, of the perimeter of the top and bottom covers. Otherwise, the remarks regarding the embodiments of FIGS. 13 and 14 are equally applicable to the embodiment of FIG. 15, and in all other respects, the embodiments of FIGS. 13 and 14 and the embodiment of FIG. 15 are identical.

The air mattresses 202, 302, 402, 502, and 2 can be made of the same materials and have the same structure. The sleeves 201, 301, and 1 and the top and bottom covers 7, 7', 407, 407', 507, and 507' can be made of the same materials.

The rectangular air mattresses, such as the air mattresses 202, 302, 402, 502, and 2, may have sides of equal length, i.e. they may be square, or they may have two parallel longer sides and two parallel shorter sides. For example, the common mattress sizes twin, full, queen, and king all have two longer sides and two shorter sides.

It should be understood that the present invention is not limited to the specific embodiments described above, but includes any and all variations or modifications within the spirit and scope of the appended claims.

The invention claimed is:

1. An air mattress assembly comprising:

an inflatable air mattress made of an expandable first material, having a single volume of air under pressure when inflated, said air mattress having a top, a bottom, two opposing sides defining a length and two opposing sides forming a width, each of the sides integrated to the top and a bottom defining a height; and a cover made of second material, including a top cover, a bottom cover and sidewalls extending between the top cover and the bottom cover, the top cover covering said top of said air mattress, said bottom cover covering said bottom of said air mattress, the sidewalls covering the two opposing sides defining the length and the two opposing sides defining the width, the air mattress being inflated to a pressure within a correct operating pressure range for use;

wherein the first material has an expansion capability greater than an expansion capability of the second material and when the air mattress is inflated to the pressure, the first material expands to a first form having a dimension, causing the second material to expand with the first material to a maximum expansion point such that both said top cover and said bottom cover are in equal and opposite tension as a result of inflating the air mattress to the pressure, thereby substantially maintaining dimension of the form with use.

2. The air mattress assembly of claim 1, wherein the cover includes an opening that allows said air mattress to be received within said cover when said air mattress is deflated, said cover being too small to receive said air mattress within said cover when said air mattress is inflated to the pressure.

3. The air mattress assembly of claim 2, wherein said opening of said cover is provided with a slide closure means to selectively close said opening after the air mattress assembly is inflated to the pressure thereby maintaining the tension.

4. The air mattress assembly of claim 3, wherein said opening extends along at least a first side of said cover and portions of two sides of said cover adjacent to said first side.

5. The air mattress assembly of claim 1, wherein the second material is made of a woven fabric.

6. The air mattress assembly of claim 1, wherein said cover has a second length and a second width in the absence of tension in said top and bottom covers, wherein said length of said air mattress prior to assembly with said cover, when inflated to pressure, is in a range of from about one to about twenty inches greater than the second length and wherein said width of said air mattress prior to assembly with said cover, when inflated to the pressure, is in the range of from about one to about twenty inches greater than the second width.

7. The air mattress assembly of claim 1, wherein said air mattress has a first raised perimeter around the top and a second raised perimeter around the bottom, wherein the equal and opposite tension between the top and bottom cover, as a result of inflating the air mattress to the pressure, elevates the top and bottom covers from the top and bottom of the air mattress.

8. The air mattress assembly according to claim 1 wherein the sidewalls are thickened with respect to the top cover and the bottom cover.

* * * * *